US005205658A

United States Patent [19]

Iriguchi

[11] Patent Number: 5,205,658

[45] Date of Patent: Apr. 27, 1993

[54] PRINT GAP DETECTING DEVICE IN PRINT HEAD

[75] Inventor: Akira Iriguchi, Nagoya, Japan

[73] Assignee: Brother Kogyo Kabushiki Kaisha, Nagoya, Japan

[21] Appl. No.: 848,149

[22] Filed: Mar. 9, 1992

[30] Foreign Application Priority Data

Mar. 8, 1991 [JP] Japan ..... 3-068874

[51] Int. Cl.[5] ..... B41J 11/20

[52] U.S. Cl. ..... 400/55; 400/124; 400/703

[58] Field of Search ..... 400/54, 55, 712, 124, 400/703, 56, 57, 58, 59, 157.1

[56] References Cited

U.S. PATENT DOCUMENTS

| | | | |
|---|---|---|---|
| 4,984,913 | 1/1991 | Silverman et al. | 400/712 |
| 5,037,217 | 8/1991 | Suzuki et al. | 400/56 |
| 5,103,680 | 4/1992 | Kanayama et al. | 73/849 |

FOREIGN PATENT DOCUMENTS

| | | | |
|---|---|---|---|
| 0379780 | 8/1990 | European Pat. Off. . | |
| 61879 | 3/1986 | Japan | 400/55 |
| 78659 | 4/1986 | Japan | 400/55 |
| 306069 | 12/1988 | Japan | 400/55 |

*Primary Examiner*—Edgar S. Burr
*Assistant Examiner*—Ren Yan
*Attorney, Agent, or Firm*—Oliff & Berridge

[57] ABSTRACT

Piezoelectric elements that can resonate at a certain frequency with a coil are extended and contracted as they are repeatedly charged and discharged. The extending and contracting movements of the piezoelectric elements are amplified and transmitted to move the print wires toward and away from the platen. The waveform of a voltage generated across the piezoelectric element is detected by a monitoring device. Then, the detected voltage waveform is compared with the waveform of a voltage that is produced when the print gap is proper, and lets the user to know the magnitude of the print gap between the distal ends of print wires and a platen at any time during printing operation.

10 Claims, 5 Drawing Sheets

FIG. 5(a)
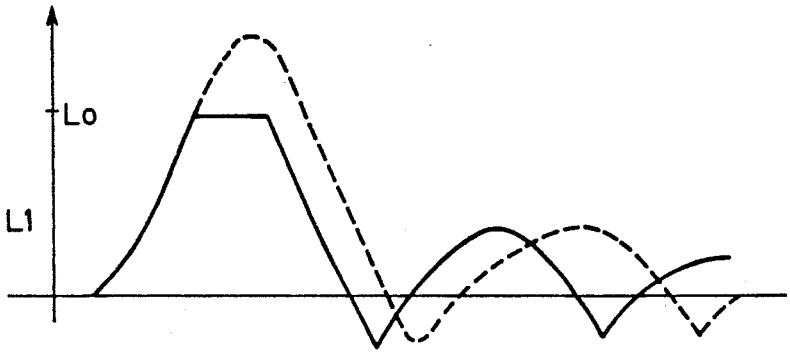
FIG. 5(b)
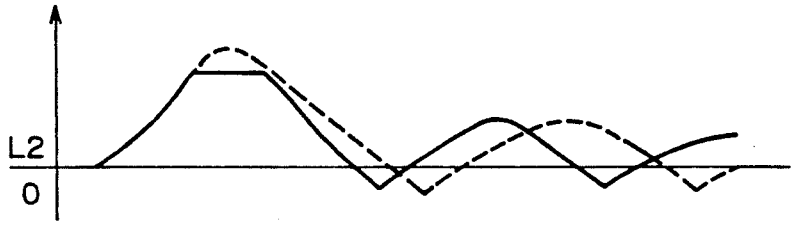
FIG. 5(c)
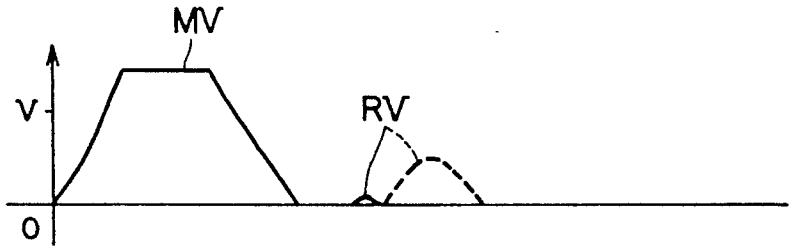
FIG. 5(d)
FIG. 5(e)
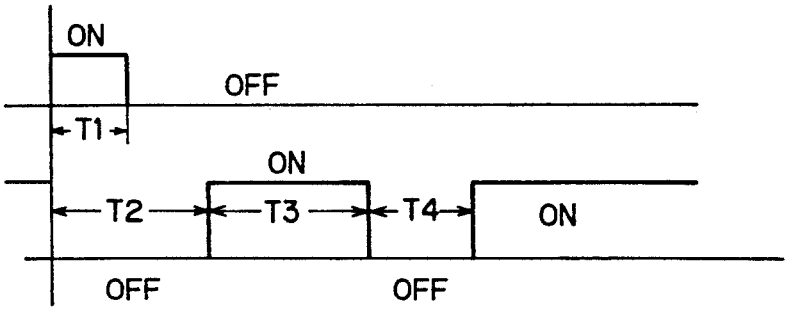

PRINT GAP DETECTING DEVICE IN PRINT HEAD

BACKGROUND OF THE INVENTION

1. Field of the Invention

The present invention relates generally to a printer, and more particularly to a print head for actuating print wires with piezoelectric elements.

2. Description of the Prior Art

There has been proposed an actuator for a print head of a dot-matrix impact printer as disclosed in U.S. patent application Ser. No. 07/426,773 filed Oct. 26, 1989 or corresponding to European Patent Application Publication No. EP 0379780A2 published Aug. 1, 1990. The proposed actuator includes a piezoelectric element that is extendable and contractable in response to the application of a voltage, and a motion transmitting mechanism for amplifying extending and contracting movements of the piezoelectric element and transmitting the amplified movement to a print wire. When the amplified movements are transmitted to the print wires, the print wires make dot impressions on a print medium such as a sheet of paper to record desired information thereon in the form of a dot matrix.

In such printers, it is necessary to set the gap between the distal ends of the print wires and a platen (hereinafter referred to as "print gap") to a suitable dimension when the piezoelectric element is not energized. If the print gap were too wide, the impacting force applied by the print wires to produce dots would be too small, resulting in a low printing density. Conversely, if the print gap were too narrow, since the print wires move laterally along the platen while being projected toward and retracted away from the sheet of paper on the platen and an ink ribbon, the print wires would tend to stick into the paper or the ink ribbon while moving laterally even when the distal ends of the print wires slightly project from the tip end of the nose of the print head. If this happened, the print wires would be damaged or would catch the ink ribbon, with a resultant print failure.

To alleviate the above possible difficulties, it has been customary to adjust the gap between the distal ends of the print wires and the platen surface to a predetermined dimension when the print head is mounted on the printer. Alternatively, the print gap has been manually or automatically adjusted depending on the number of sheets of paper on the platen, the thickness of the paper on the platen, etc.

When the print wires become too short during long usage of the print head or an error occurs in a manual adjustment of the print gap, if the user continues printing without noticing the abnormal condition of a widened print gap, then the service life of the print head will be extremely reduced.

SUMMARY OF THE INVENTION

In view of the aforesaid problems, it is an object of the present invention to provide a print head device having means for easily detecting an abnormal print gap to increase the durability of a print head, operate a printer properly, and effect a proper printing process.

To achieve the above and other objects, there is provided in one aspect of the present invention a print gap detecting device which detects a print gap between a distal end of a print wire and a platen in a dot impact printer. The printer has an actuator for actuating the print wire with amplified extending and contracting movements of a piezoelectric element by virtue of a motion transmitting mechanism responsive to a voltage applied thereto. The detecting device comprises monitoring means for monitoring a waveform of the voltage across the piezoelectric element, and determining means for determining a magnitude of the print gap based on the waveform of the voltage.

In accordance with another aspect of the present invention, there is provided a printer having a platen, and a plurality of print wires. Each print wire has a distal end disposed in confronting relation to the platen. A plurality of piezoelectric elements are coupled in one-to-one correspondence to the plurality of print wires. The piezoelectric element is extended and contracted in response to a voltage applied thereto and its extending and contracting movements are amplified by virtue of motion transmitting means. The printer includes a print gap detecting means for detecting a print gap between the distal end of each print wire and the platen. The print gap detecting means comprises monitoring means for monitoring a waveform of the voltage across the piezoelectric element, and determining means for determining a magnitude of the print gap based on the waveform of the voltage.

BRIEF DESCRIPTION OF THE DRAWINGS

The particular features and advantages of the invention as well as other objects will become apparent from the following description taken in conjunction with the accompanying drawings, in which:

FIG. 5(*a*) is a timing chart showing the manner in which print wires 10 are actuated;

FIG. 5(*b*) is a timing chart showing the manner in which a movable member 22 operates;

FIG. 5(*c*) is a timing chart showing the manner in which a voltage V across piezoelectric elements 13 varies;

FIG. 5(*d*) is a timing chart of a charging voltage pulse CHGP;

FIG. 5(*e*) is a timing chart of a discharging voltage pulse DCHGP; and

DETAILED DESCRIPTION OF THE PREFERRED EMBODIMENTS

Figure 2:
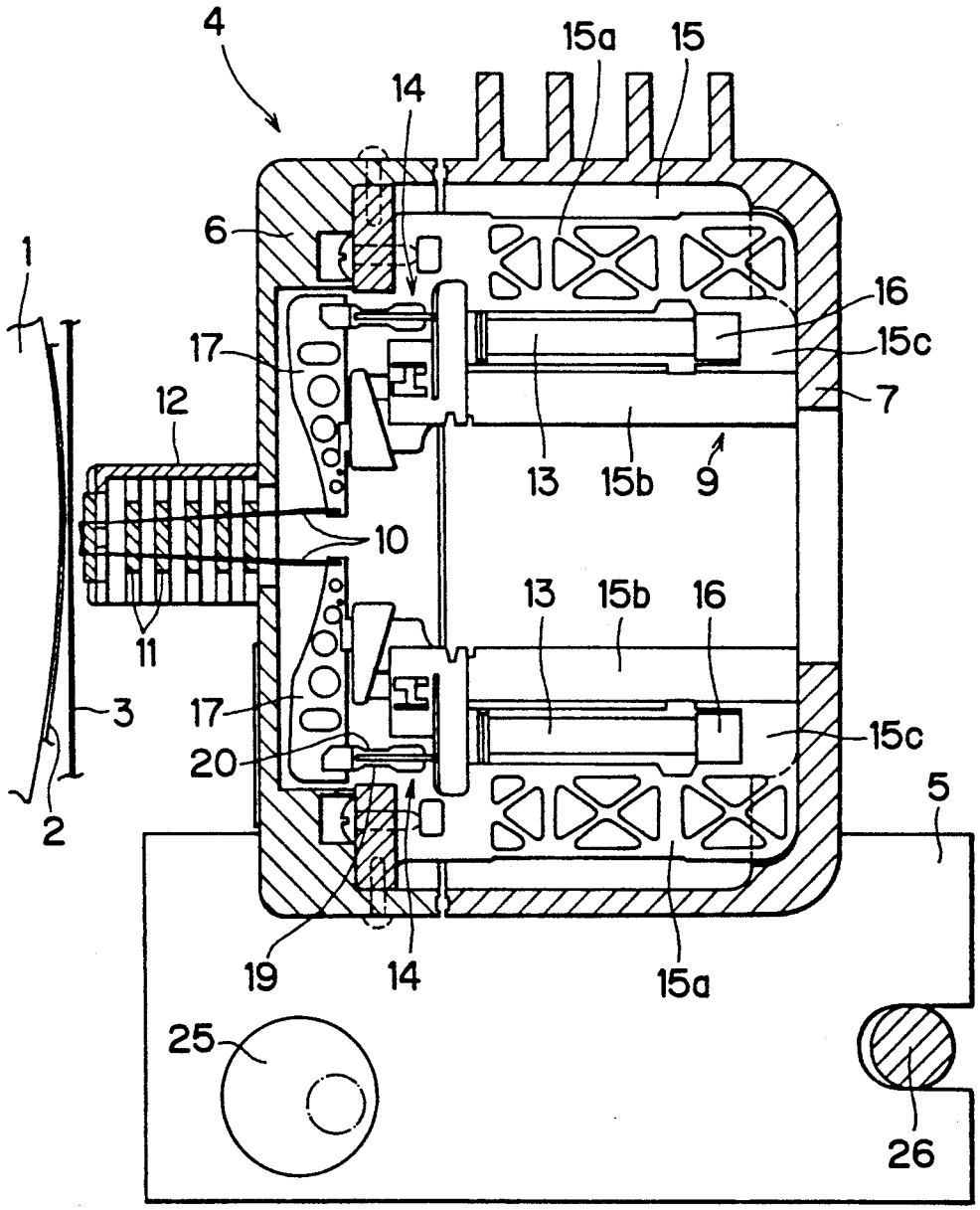
FIG. 2 is a sectional side elevational view of the print head.

As shown in FIG. 2, an ink ribbon 3 is disposed over the surface of a sheet of paper 2 that is supplied onto a platen 1 in a printer. A dot-matrix impact print head device 4 has a nose 12 positioned in confronting relationship to the outer circumferential surface of the platen 1. The dot-matrix impact print head device 4 is mounted on a carriage 5 that is reciprocally movable in the longitudinal direction of the platen 1 by a step motor (not shown).

The carriage 5 is movable on and along two guide shafts 25, 26 that extend through the carriage 5. The guide shaft 25 is angularly movable about an eccentric shaft thereof, which is connected to a step motor (not shown) for adjusting a head gap. The guide shaft 26 allows the carriage 5 to move toward and away from the platen 1.

Figure 3:
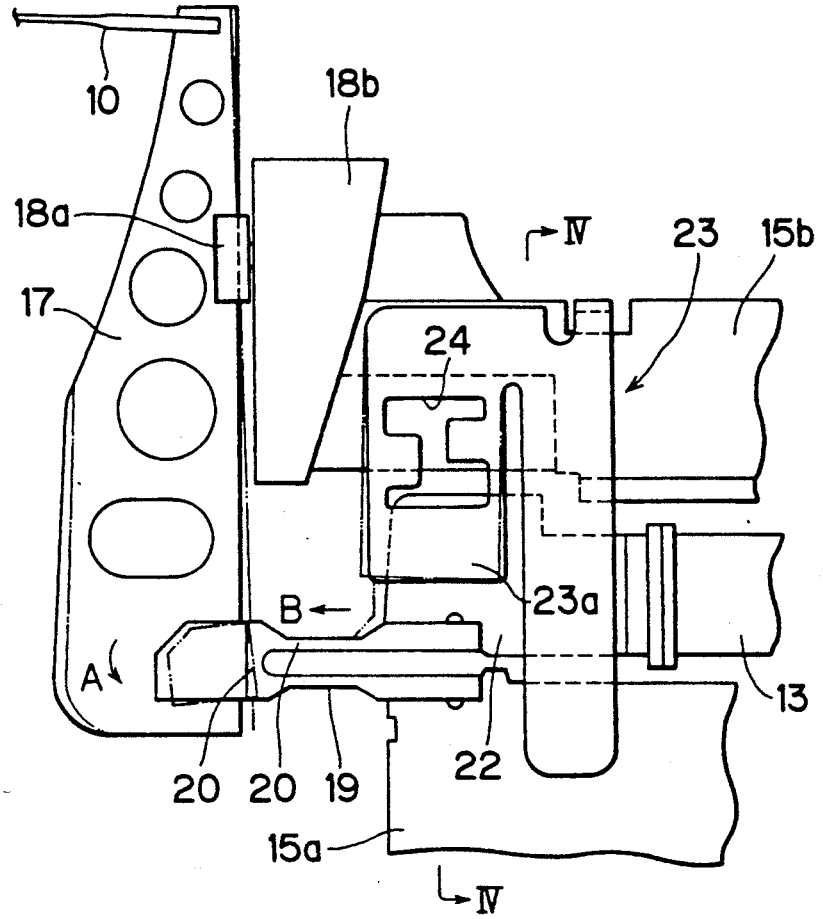
FIG. 3 is an enlarged fragmentary side elevational view of a print unit.
Figure 4:
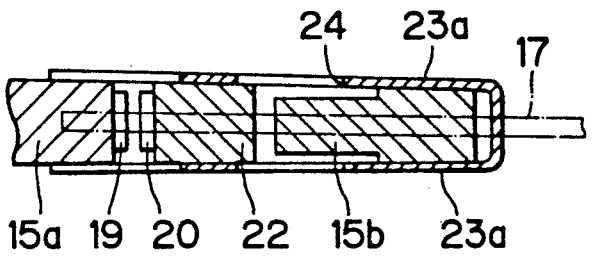
FIG. 4 is a cross-sectional view taken along line IV—IV of FIG. 2.

FIGS. 2 through 4 show the dot-matrix impact print head device 4 in detail. The dot-matrix impact print head device 4 comprises a head body 6 substantially in the shape of a circular plate as viewed in front elevation, and a cover 7 including a tubular skirt integrally extending from the outer peripheral edge of a connector substantially in the shape of a circular plate toward the rear side of the head body 6. The head body 6 and the cover 7 are made of aluminum alloy.

The dot-matrix impact print head device 4 includes a plurality of radial print units 9 disposed behind the head body 6. The head body 6 supports the hollow nose 12 projecting on its front surface. The nose 12 has a plurality of guide plates 11 by which print wires 10 of the respective print units 9 are longitudinally movably supported for movement toward and away from the platen 1. Each of the print units 9 comprises a piezoelectric element 13 which is elongate parallel to the print wires 10 and comprises a stack of bonded piezoelectric ceramic units, a motion transmitting mechanism 14 mounted on a front end of the piezoelectric element 13 for amplifying extending and contracting movements of the piezoelectric element 13 and transmitting the amplified movements to the corresponding print wire 10, and a support frame 15 supporting the piezoelectric element 13 and the motion transmitting mechanism 14. The support frame 15 is of an integral unitary structure in a channel shape composed of a main column 15*a*, an auxiliary column 15*b*, and a rear end 15*c*, which jointly surround longitudinally opposite sides and rear end of the piezoelectric element 13.

When a voltage is applied to the piezoelectric element 13, the piezoelectric element 13 is extended along the stack thereof, i.e., in the longitudinal direction thereof. When the applied voltage is removed, the piezoelectric element 13 contracts in the direction in which the piezoelectric ceramic units are stacked. A temperature compensation member 16 having a positive coefficient of thermal expansion for correcting the dimensions of the piezoelectric element 13 which is contracted when the temperature increases, is interposed between the rear end of the piezoelectric element 13 and the rear end 15*c* of the support frame 15.

The motion transmitting mechanism 14 is of the following arrangement: The print wire 10 has a proximal end fixed to a distal end of an arm 17 which is substantially triangular in shape as viewed in side elevation. The arm 17 has a proximal end to which there is fixed a joint 21 joining the distal ends of parallel first and second leaf springs 19, 20 that extend longitudinally rearwardly of the main column 15*a*. The first leaf spring 19 has a proximal end secured to a side of the main column 15*a*, and the second leaf spring 20 has a proximal end secured to a side of a movable member 22 that is secured to the front end of the piezoelectric element 13.

When a voltage is applied, the piezoelectric element 13 is extended and the movable member 22 is moved in the direction indicated by the arrow B (FIG. 4). The joint 21 which interconnect the springs 19, 20 is angularly displaced in the direction indicated by the arrow A, and the angular displacement of the joint 21 is amplified by the arm 17 to cause the print wire 10 to project from the nose.

When the voltage is removed, the arm 17 is angularly moved back under the resiliency of the springs 19, 20 until a stop 18*a* of synthetic resin or the like which is mounted on the arm 17 abuts against and is stopped by a stop 18*b* mounted on the support frame 15.

As shown in FIGS. 3 and 4, a quadric link mechanism 23 is disposed astride of the other side of the movable member 22 and the auxiliary column 15*b*. The quadric link mechanism 23 is in the form of a resilient member such as a spring sheet, and has a pair of wider side panels 23*a* each having a recess 24 that is substantially H-shaped as viewed in side elevation. The wider side panels 23*a* are brazed to front and back sides of the auxiliary column 15*b* and also front and back sides of the movable member 22 radially outwardly of the recesses 24. When the piezoelectric element 13 is extended and contracted in response to a voltage applied thereto, the wider side panels 23*a* are elastically deformed into the shape of a parallelogram as viewed in side elevation, moving the movable member 22 in the longitudinal direction of and parallel to the auxiliary column 15*b* that is fixed in position with respect to the movable member 22, as indicated by the two-dot-and-dash lines in FIG. 3.

Since the movable member 22 is movable in the longitudinal direction of and parallel to the auxiliary column 15*b*, i.e., linearly in the longitudinal direction of the piezoelectric element 13, no bending stresses are applied to the bonded surfaces of the stacked piezoelectric ceramic units, and hence the stacked piezoelectric ceramic units will not be peeled off accidentally along the bonded surfaces.

Figure 1:
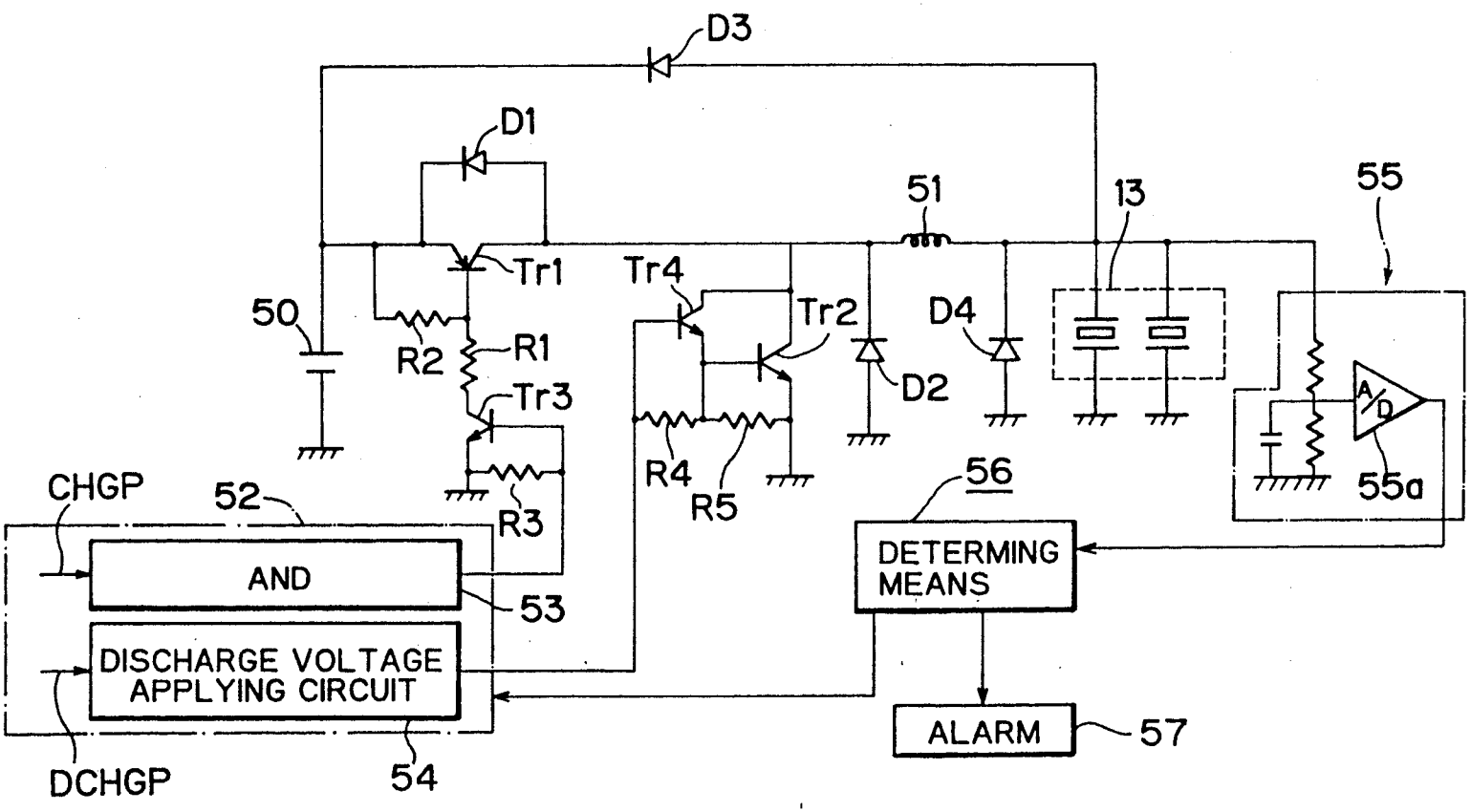
FIG. 1 is a diagram of a driver circuit for a print head.

FIG. 1 shows a driver circuit for the piezoelectric elements 13 of the print units. The driver circuit has a DC power supply 50, a transistor Tr1, a coil 51, and the piezoelectric elements 13 which are connected in series with each other. The DC power supply 50 has a negative terminal grounded, and the piezoelectric elements 13 have respective electrodes as negative terminals grounded. The transistor Tr1 has a forward direction, which is the forward direction of the circuit, from the positive terminal of the DC power supply 50 toward electrodes as positive terminals of the piezoelectric elements 13.

The transistor Tr1 and the coil 51 are connected through a junction that is grounded through a transistor Tr2. The transistor Tr2 has a forward direction from the junction between the transistor Tr1 and the coil 51 toward ground.

The transistors Tr1, Tr2 are shunted respectively by diodes D1, D2 whose forward directions are opposite to the forward directions of the transistors Tr1, Tr2, respectively.

A diode D3 is connected between the positive terminal of the DC power supply 50 and the electrodes as the positive terminals of the piezoelectric elements 13, the diode D3 being parallel to the transistor Tr1 and the coil 51. The diode D3 has a forward direction toward the positive terminal of the DC power supply 50.

A diode D4 is connected parallel to the piezoelectric elements 13. The diode D4 has a forward direction from the electrodes as the negative terminals of the piezoelectric elements 13 toward the electrodes as the positive terminals thereof.

The transistors Tr1, Tr2 are switched between nonconductive and conductive states by a control circuit 52 as a switching means. The control circuit 52 has an AND gate 53 that operates when a charging pulse is applied. The AND gate 53 has an output terminal connected to the base of the transistor Tr3. The transistor Tr3 has an emitter grounded and a collector connected to the base of the transistor Tr1 through a resistor R1. The resistor R1 and the emitter of the transistor Tr1 are interconnected by a resistor R2. A resistor R3 interconnects the emitter of the transistor Tr3 and the output terminal of the AND gate 53.

The transistors Tr2, Tr4 have their collectors connected to each other. The emitter of the transistor Tr4 is connected to the base of the transistor Tr2. The control circuit 52 has a discharge voltage applying circuit 54 whose output terminal is connected to the base of the transistor Tr4. The output terminal of the discharge voltage applying circuit 54 is also connected through series-connected resistors R4, R5 to the emitter of the transistor Tr2. The junction between the resistors R4, R5 is connected to the emitter of the transistor Tr4.

The waveform of a voltage generated by the piezoelectric elements 13 and the voltage itself are detected and monitored by a monitoring means 55, which is primarily composed of an A/D converter 55*a*. The monitoring means 55 detects a voltage waveform PV which is produced across the piezoelectric elements 13 after a main voltage waveform MV developed when the piezoelectric elements 13 are charged and discharged for printing (see FIG. 5(*c*)).

A determining means 56 serves to determine any abnormal print gap from the waveform of the voltage pulse produced by the piezoelectric elements 13 that is detected by the monitoring means 55. The determining means 56 comprises a determining circuit such as a comparator for determining whether the produced voltage pulse is larger or smaller than a threshold value that is equal to the peak value of a voltage waveform which is produced when the print gap is proper. When the print gap is determined as abnormal, an alarming device 57 such as a voice generator, a buzzer, a lamp, or the like produces an alarming signal for the user. The printer may be arranged such that its printing operation is automatically canceled by the alarming signal.

The control circuit 52 is also effective to control the overall printer which incorporates the dot-matrix impact print head 4. The control circuit 52 comprises a microcomputer, and includes a built-in timer.

When a print command is applied to the control circuit 52, it applies a drive (charging) voltage pulse CHGP to the AND gate 53 to make its output signal high, turning on the transistor Tr3 to render the transistor Tr1 conductive. The charges from the DC power supply 50 now flow through the transistor Tr1 and the coil 51 into the piezoelectric elements 13. The coil 51 and the piezoelectric elements 13 are charged while in resonance. The piezoelectric elements 13 are deformed (extended), and the extending deformation thereof is transmitted by the motion transmitting mechanism 14 to project the print wires 10 from the nose 12 to print on the paper 2.

The control circuit 52 waits until the piezoelectric elements 13 are sufficiently charged. After the piezoelectric elements 13 are sufficiently charged, the coil 51 acts to cause a current to flow continuously in a closed current loop through the diode D3 and the transistor Tr1, maintaining a current flowing through the coil 51, as long as the transistor Tr1 is turned on. When the transistor Tr1 is turned off after the piezoelectric elements 13 are sufficiently charged, the current continuously flows in a closed loop through the coil 51, the diode D3, the DC power supply 50, and the diode D2, and is then attenuated. During this time, the charges are consumed gradually by the piezoelectric elements 13, which however remain displaced because charges are supplied from the coil 51.

When the current flowing through the coil 51 is attenuated and after elapse of a period of time in which the piezoelectric elements 13 are displaced to effect printing, the control circuit 52 renders the transistor Tr2 conductive in response to a discharging voltage pulse DCHGP. The charges stored in the piezoelectric elements 13 are now caused to flow in a closed loop from the coil 51 to the transistor Tr2 to ground. Upon elapse of a certain period of time, the electric energy according to the charges stored in the piezoelectric elements 13 is entirely stored as magnetic energy in the coil 51.

When the transistor Tr2 is thereafter turned off by the control circuit 52, a current tends to flow continuously in the coil 51. This current flows through the diode D1 back to the DC power supply 50. The magnetic energy stored in the coil 51 is returned in its entirety to the DC power supply 50. If the time required to discharge the piezoelectric elements 13 is longer than the time required to charge the piezoelectric elements 13, then the secondary bound of the motion transmitting mechanisms 14 of the print units 9 may be reduced.

FIG. 5 shows timing charts with time indicated by their horizontal axes. The solid line curves are plotted when the print gap is of a proper value L0. The dotted-line curves are plotted when the print gap is larger (e.g., it is too large for the distal ends of the print wires 10 to reach the platen even though they are actuated for printing). FIG. 5(*a*) shows the manner in which the print wires 10 are actuated, the vertical axis representing the print gap L1. FIG. 5(*b*) shows the manner in which the movable member 22 operates, the vertical axis representing the distance L2 traversed by the movable member 22. FIG. 5(*c*) shows the manner in which the voltage V across the piezoelectric elements 13 varies. FIG. 5(*d*) is a timing chart of the charging voltage pulse CHGP. FIG. 5(*e*) is a timing chart of the discharging voltage pulse DCHGP.

As can be understood from FIG. 5, when the charging voltage pulse CHGP is applied for a time T1 after the print command and also when the discharging voltage pulse DCHGP is applied for a time T3 following an OFF or quiescent time T2 after the print command, the main voltage MV is applied to the piezoelectric elements 13 immediately before the discharging voltage pulse is applied. The main voltage MV has a maximum voltage value of about 130 volts, for example. Under the applied main voltage MV, the print wires 10 are caused by the piezoelectric elements 13 to move forwardly toward the surface of the platen 1. When the print wires 10 hit the surface of the platen 1, they are prevented from moving forwardly any further, remain in engagement with the surface of the platen 1 for a certain period of time, and are thereafter retracted. Thereafter, the print wires 10 move in the manner described below. When the main voltage MV is applied to the piezoelectric elements 13, they displace the movable members 22, applying elastically deforming forces to the leaf springs 19, 20 of the motion transmitting mechanism 14 for thereby turning the arms 17 for printing.

After the application of the main voltage MV is finished and also the application of the discharging voltage pulse DCHGP for the time T3 is finished, an OFF or quiescent time T4 is given, allowing the current discharged from the piezoelectric elements 13 to return to the DC power supply 50. If an external force is applied to the piezoelectric elements 13 at this time, a voltage waveform PV is developed across the piezoelectric elements 13 for the reasons described below.

The voltage waveform PV is produced by retracted displacement of the print wires 10 or collision of the movable members 22 with the piezoelectric elements 13. More specifically, in the presence of the print gap L1, the two leaf springs 19, 20 of each of the motion transmitting mechanisms 14 store the energy of an elastic strain depending on the distance traversed by the print wire 10 as is moves forwardly. Under reactive forces produced by the stored energy, the leaf springs 19, 20 are elastically deformed back in the direction in which the print wire 10 is retracted. At this time, the movable member 22 to which the second leaf spring 20 is fixed is also retracted, imposing an compressive external force on the piezoelectric element 13. Under such compressive external force applied, the piezoelectric element 13 develops the voltage waveform PV.

If the print gap L1 is large, the distance traversed by the print wire 10 as it moves forwardly is also large. Therefore, the two leaf springs 19, 20 store a large amount of elastic strain energy. The distance that the movable member 22 is retracted and the compressive external force applied to the piezoelectric element 13 are also large. Consequently, the peak voltage PV0 of the voltage waveform PV developed by the piezoelectric element 13 is larger as the print gap is larger. For example, when the print gap is of a proper value L0, the peak voltage PV0 is in the range of from 5 to 10 volts, and when the print gap is too large for the print wire 10 to reach the platen 1, the peak voltage PV0 is about 20 volts. The wider the print gap L1, the later the time for the movable member 22 to return and the longer the period of time until the retracted movable member 22 pushes the piezoelectric element 13. Therefore, the voltage waveform PV developed under the above reactive forces occurs at a later time than when the print gap is proper (see the dotted-line curve in FIG. 5(*c*)).

As shown in FIG. 5(*e*), until the movable member 22 returns with the proper print gap L9, the discharging voltage pulse CDHGP is applied. Thereafter, the OFF time T4 is given during which the piezoelectric elements 13 are monitored for the voltage waveform PV and its peal voltage PV0 by the monitoring means 55. The determining means 56 compares the peak voltage PV0 and a peak voltage PV0' produced when the print gap is of a proper value L0, thereby determining the magnitude of the peak voltage PV0. If the detected peak voltage PV0 is larger a certain value than the peak voltage PV0', then the determining means 56 produces a danger signal (or displays a danger) indicating that the print gap is too large, causing the alarming device 57 to issue an alarming signal.

When such a signal is produced, the control circuit 52 may control the printer to automatically stop its printing operation.

The print gap that is too large may manually be corrected by the user.

If the detected peak voltage PV0 falls within a predetermined allowable range with respect to the peak voltage PV0', then the determining means 56 produces a signal (or displays a signal) indicating that the print gap is proper. Conversely, if the detected peak voltage PV0 is much smaller than the peak voltage PV0', then the determining means 56 produces a signal (or displays a signal) indicating that the printer condition is not suitable for printing operation.

Figure 6:
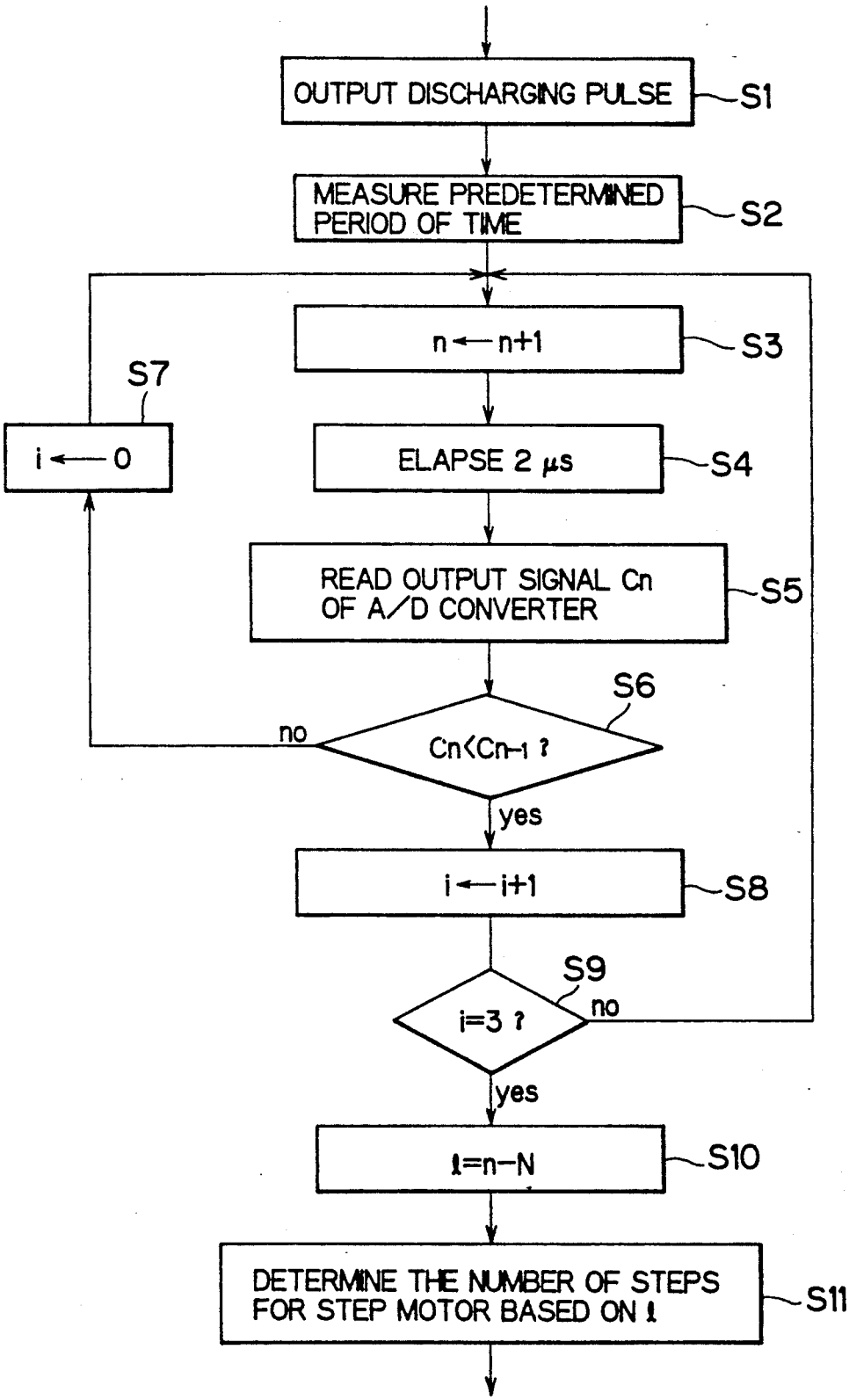
FIG. 6 is a flowchart of operation of a central processing unit in a determining means 56.

In the above embodiment, the print gap is determined based on the peak voltage of the voltage waveform. However, the print gap may be determined based on the time at which the peak voltage occurs. A control process for such modified print gap determination will be described below with reference to FIG. 6. FIG. 6 shows a flowchart of operation of a central processing unit (CPU) in the determining means 56.

After the discharging voltage pulse is outputted in a step S1, a predetermined period of time is measured in a step S2. After the predetermined period of time is measured, a variable n (a value corresponding to the number of times a flow loop is repeated at a predetermined interval of time) that has been reset to "0" is incremented in a step S3. After elapse of two microseconds, for example, in a step S4, the output signal Cn from the A/D converter is read in a step S5. Then, a step S6 determines whether the read output signal Cn is smaller than a previous output signal Cn-1 (in an initial cycle, the previous output signal is provisionally set to a sufficiently high value). If the output signal Cn is larger than the previous output signal Cn-1 (NO in the step S6), then a variable i (a value corresponding to the number of times the output signal is read) is reset to "0" in a step S7, and thereafter control returns to the step S3.

If the output signal Cn is smaller than the previous output signal Cn-1 (YES in the step S6), then the variable i is incremented in a step S8. If the variable i is not "3" (NO in a step S9), then control goes back to the step S3. That is, control waits until the output signal Cn is low in value in successive three cycles. If the variable i is "3" (YES in the step S9), then a variable l is produced by subtracting a value N from the variable n at the time $l=n-N$) in a step S10. Basically, the value N is equal to the variable n when the head gap is proper. Thereafter, the step motor for adjusting the head gap is energized for an angular displacement that is determined based on the variable l (corresponding to the number of steps to energize the step motor therethrough) in a step S11. The number of steps through which the step motor is energized stepwise may be determined from a look-up table addressed by the variable l. The look-up table may be addressed by the variable l and the peak voltage PV0. The number of pulses applied to the step motor may be determined by multiplying the variable l by a suitable constant. The step motor is reversed when a negative number of pulses are applied thereto. The look-up table used to determine the number of steps for the step motor contains numbers of steps to be referred to that have been experimentally determined.

A maximum voltage value read by the A/D converter may be determined, and an error condition may be displayed when the maximum voltage value exceeds a certain value. The number of steps through which the step motor is energized stepwise may be determined from a look-up table addressed by the maximum value read by the A/D converter.

With the present invention, the print gap detecting device has monitoring means for monitoring the waveform of a voltage generated by the piezoelectric elements, and determining means for determining the magnitude of the print gap from the waveform of the voltage. Therefore, the magnitude of the print gap can be determined at any time during printing operation, making it possible to avoid a condition in which the printing operation is continued for a long period of time with an excessively wide print gap. Consequently, the durability of the print head is increased, the printer operates properly, and the printing process is effected properly.

I claim:

1. A print gap detecting device for detecting a print gap between a distal end of a print wire and a printing paper wrapped around a platen in a dot impact printer having an actuator for actuating the print wire with amplified extending and contracting movements of a piezoelectric element by virtue of a motion transmitting mechanism responsive to a voltage applied to the piezoelectric element, the detecting device comprising:

monitoring means for monitoring a waveform of a voltage induced across the piezoelectric element after the contracting movement; and determining means for determining the magnitude of the print gap based on a peak level of the waveform of the voltage induced thereacross.

2. The device according to claim 1, wherein said determining means comprises comparison means for comparing a level of the waveform of the voltage with a reference voltage level developed across said piezoelectric element when the print gap is proper.

3. The device according to claim 2, further comprising alarming means for alarming an abnormality of the print gap when said determining means indicates that the level of the waveform of the voltage is out of a predetermined range.

4. The device according to claim 1, wherein said determining means determines that a peak level of the waveform of the voltage appears after elapse of a predetermined period of time from a time when the print wire is instructed to perform a contracting movement by said actuator.

5. The device according to claim 4, further comprising alarming means for alarming an abnormality of the print gap when said observing means indicates that the peak level of the waveform of the voltage appears within a predetermined time range.

6. A printer comprising:

a platen having a printing paper wrapped thereon;

a plurality of print wires, each having a distal end;

a plurality of piezoelectric elements coupled in one-to-one correspondence to said plurality of print wires, each piezoelectric element being extended and contracted in response to a voltage applied to each piezoelectric element;

motion transmitting means for amplifying extending and contracting movement of each of said plurality of piezoelectric elements; and print gap detecting means for detecting the print gap between the distal end of each print wire and said printing paper on the platen, said print gap detecting means comprising monitoring means for monitoring a waveform of a voltage induced across the piezoelectric element after its contracting movement, and determining means for determining the magnitude of the print gap based on a peak level of the waveform of the voltage induced thereacross.

7. The printer according to claim 6, wherein said determining means comprises comparison means for comparing a level of the waveform of the voltage with a reference voltage level developed across said piezoelectric element when the print gap is proper.

8. The printer according to claim 7, further comprising alarming means for alarming an abnormality of the print gap when said determining means indicates that the level of the waveform of the voltage is out of a predetermined range.

9. The printer according to claim 6, wherein said determining means determines that a peak level of the waveform of the voltage appears after elapse of a predetermined period of time from a time when the print wire is instructed to perform a contracting movement by said actuator.

10. The printer according to claim 9, further comprising alarming means for alarming an abnormality of the print gap when said observing means indicates that the peak level of the waveform of the voltage appears within a predetermined time range.

* * * * *